United States Patent [19]

Fujii et al.

[11] Patent Number: 4,472,699

[45] Date of Patent: Sep. 18, 1984

[54] ELECTROMAGNETIC RELAY

[75] Inventors: Kunihisa Fujii, Saku; Noboru Tomono, Usudamachi; Hajime Watanabe; Tetsuo Kito, both of Saku, all of Japan

[73] Assignee: Takamisawa Electric Co., Ltd., Tokyo, Japan

[21] Appl. No.: 396,271

[22] Filed: Jul. 8, 1982

[30] Foreign Application Priority Data

Jul. 20, 1981 [JP] Japan ..... 56-112122

[51] Int. Cl.[3] ..... H01F 3/00

[52] U.S. Cl. ..... 335/281; 335/85; 335/297

[58] Field of Search ..... 335/84, 85, 124, 125, 335/202, 281, 278, 297; 24/255 BS, 255 SL, 243 E

[56] References Cited

U.S. PATENT DOCUMENTS

| | | | |
|---|---|---|---|
| 2,632,071 | 3/1953 | Rinke | 335/297 |
| 3,688,229 | 8/1972 | Bloch | 335/203 |
| 3,711,801 | 1/1973 | Bloch | 335/187 |
| 3,870,982 | 3/1975 | Shibano | 335/297 |

FOREIGN PATENT DOCUMENTS

| | | | |
|---|---|---|---|
| 2617632 | 11/1977 | Fed. Rep. of Germany | 335/128 |
| 1217270 | 5/1960 | France | 335/297 |
| 561122 | 4/1957 | Italy | 335/297 |

*Primary Examiner*—J. D. Miller
*Assistant Examiner*—Jeffrey Sterrett
*Attorney, Agent, or Firm*—Armstrong, Nikaido, Marmelstein & Kubovcik

[57] ABSTRACT

In an electromagnetic relay, an electromagnet is constructed from an approximately U-shaped magnetic pole piece, an approximately U-shaped magnetic yoke, and an armature. One side leg of the magnetic pole piece, one side leg of the magnetic yoke, and the armature are accomodated in the central hole of a bobbin so that the efficiency of the conversion of electrical power into a driving force is increased.

3 Claims, 6 Drawing Figures

ELECTROMAGNETIC RELAY

BACKGROUND OF THE INVENTION

1. Field of the Invention

The present invention relates to an electromagnetic relay. The size of the electromagnetic relay according to the present invention is, for example, 20 mm×10 mm×15 mm.

2. Description of the Prior Art

In general, the electromagnet of an electromagnetic relay consists of a bobbin, a coil, a fixed magnetic core, and a movable armature. The armature is adapted so as to be actuated upon excitation of the coil and thus is attracted to the fixed magnetic core. Usually in such electromagnet, the central portion of the U-shaped fixed magnetic core is inserted into the central hole of the bobbin and the two legs of the U-shaped core protrude outside the bobbin. The armature is also located outside the bobbin so as to bridge the two legs of the U-shaped core. Such a structure can be called an external armature-type structure.

In such a structure of the electromagnet, there is a problem in that utilization of the generated magnetic flux is unsatisfactory. Usually, only 60% of the generated magnetic flux is utilized as the operation force of the electromagnet. Accordingly, the electrical power supplied to the electromagnet cannot be satisfactorily utilized in the operation of the electromagnetic relay.

SUMMARY OF THE INVENTION

It is the main object of the present invention to provide an improved electromagnet for an electromagnetic relay in which the efficiency of the conversion of electrical power into a driving force for the armature is enhanced and a greater driving force for the armature is obtained by using an electromagnet having a relatively compact structure.

In accordance with the fundamental aspect of the present invention, there is provided an electromagnetic relay having an electromagnet comprising: a bobbin with a central hole having guide grooves as the enlarged cross-section of said central hole, a coil wound on said bobbin, an approximately U-shaped magnetic pole piece, one leg of which is longer than the other leg, an approximately U-shaped magnetic yoke, one leg of which is longer than the other leg, and an armature, wherein the short leg of said magnetic pole piece and the short leg of said magnetic yoke are inserted into the central hole of said bobbin along said guide grooves, the long leg of said magnetic piece and the long leg of said magnetic yoke are laminated or overlapped outside said bobbin, the external surface of the short leg of said magnetic pole piece and the external surface of the short leg of said magnetic yoke are aligned with each other to form a magnetic attraction surface, and said armature is also inserted into the central hole of said bobbin.

DESCRIPTION OF THE PREFERRED EMBODIMENT

Figure 1:
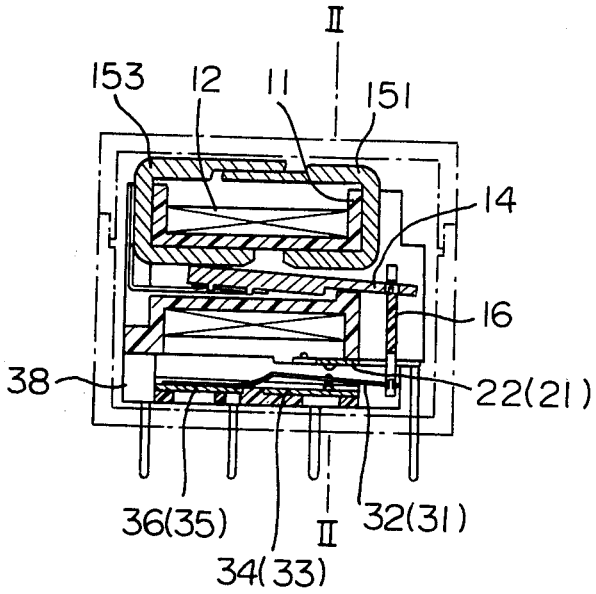
FIG. 1 illustrates an electromagnetic relay according to an embodiment of the present invention.
Figure 2:
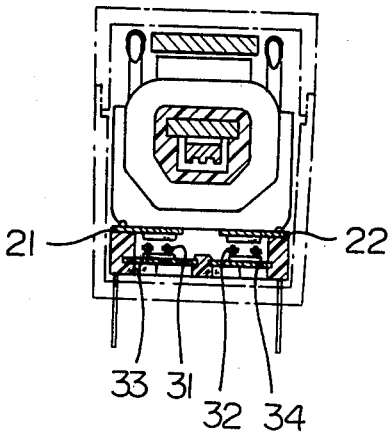
FIG. 2 illustrates a cross-sectional view taken along line II—II of FIG. 1, FIGS. 3A and 3B illustrate the process of assembling the electromagnet for the electomagnetic relay of FIG. 1, and FIGS. 4 and 5 illustrate the structure of the magnetic pole piece and the magnetic yoke in accordance with modified embodiments of the present invention.

An electromagnetic relay according to an embodiment of the present invention is illustrated in FIGS. 1 and 2. FIG. 2 illustrates a cross-sectional view of the electromagnetic relay of FIG. 1.

The electromagnetic relay of FIGS. 1 and 2 comprises bobbin 11 made of plastics, coil 12, armature 14, magnetic pole piece 151, magnetic yoke 153, and card 16, one end of card 16 being coupled to armature 14. The electromagnetic relay of FIGS. 1 and 2 also comprises make-side fixed contact springs 21 and 22, base block 38, movable contact springs 31 and 32, and break-side fixed contact springs 33 and 34. Movable contact spring 31 is fixed to spring 35 while movable contact spring 32 is fixed to spring 36.

Figure 3A:
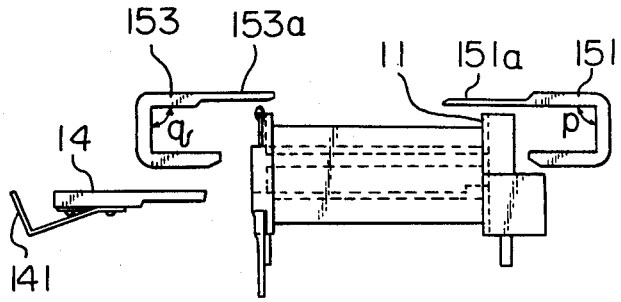
Figure 3B:
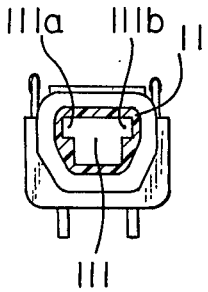

FIGS. 3A and 3B illustrate the manner of inserting magnetic pole piece 151, magnetic yoke 153, and armature 14 into central hole 111 of bobbin 11. As illustrated in FIG. 3B, the cross-section of central hole 111 of bobbin 11 has a rectangular shape and has enlarged portions **111*a* and 111*b* at the top. Enlarged portions 111*a* and 111*b* serve as guide grooves for maginetic pole piece 151 and magnetic yoke 153** to be inserted.

As illustrated in FIG. 3A, both magnetic pole piece 151 and magnetic yoke 153 are U-shaped. An L-shaped hinge spring 141 is fixed to armature 14.

Magnetic pole piece 151 and magnetic yoke 153 are inserted into central hole 111 of bobbin 11, being guided by guide grooves **111*a* and 111*b*. Simultaneous with the insertion of magentic yoke 153, armature 14 is inserted into central hole 111 of bobbin 11. If hinge spring 141 fixed to armature 14 is preliminarily fixed to magnetic yoke 153, armature 14 is inserted into central hole 111 of bobbin 11 automatically and simultaneous with the insertion of magnetic york 153**.

The cross-sectional size of guide grooves **111*a* and 111*b* are selected slightly less than the cross-sectional size of the short leg of magnetic pole piece 151 and the short leg of magnetic yoke 153. Hence, the short leg of magnetic pole piece 151 and the short leg of magnetic yoke 153 are inserted under pressure into central hole 111 of bobbin 11 so that tight coupling between the magnetic pole piece 151 and the magnetic yoke 153 and the bobbin 11** is ensured.

As one side leg of U-shaped magnetic pole piece 151 and one side leg of magnetic yoke 153 are inserted into central hole 111 of bobbin 11, the other side leg of U-shaped pole piece 151 and the other side leg of magnetic yoke 153 are fitted with overlapping end portions **151*a* and 153*a*, respectively, on the external side of bobbin 11**, thereby closing the magnetic path of the electromagnet.

When the insertion is carried out by using magnetic pole piece 151, the upper corner angle p of which is selected so as to be slightly greater than 90°, and magnetic yoke 153, the upper corner angle q of which is selected so as to be slightly less than 90°, resilient forces are exerted at overlapping end portions **151*a* and 153*a* in the state illustrated in FIG. 1 so as to ensure tight fitting of end portions 151*a* and 153*a***.

In the electromagnetic relay of FIG. 1, since the armature is located inside the bobbin, the magnetic flux generated by the coil current is effectively utilized to drive the armature with a relatively low loss of magnetic flux. Hence, the efficiency of the conversion of electrical power into a driving force is relatively high, and, accordingly, a considerably great driving force is obtained.

Also, since portions of the magnetic pole piece and the magnetic yoke and armature are accomodated in the central hole of the bobbin, the size of the electromagnet is considerably reduced. Hence, a compact structure of an electromagnetic relay having a reliable operation characteristic can be realized. Further, the alignment of the external surface of the short leg of the magnetic pole piece and the external surface of the magnetic yoke to form a flat magnetic attraction surface is realized with a high precision.

Although a preferred embodiment of the present invention has been described heretofore, it should be understood that various modifications of such embodiment are possible without departing from the scope of the present invention.

Figure 4:
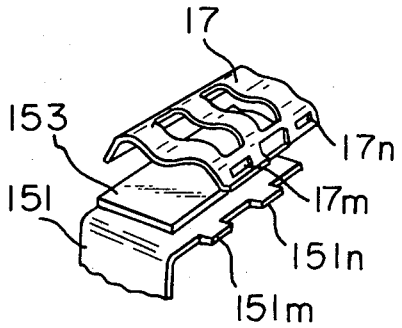
Figure 5:
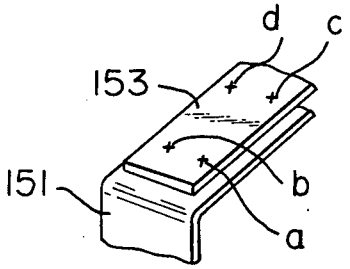

An example of the modified embodiments is illustrated in FIGS. 4 and 5. In the structure of FIG. 4, projections 151*m* and 151*n* are provided on the side edge of magnetic pole piece 151. Magnetic pole piece 151 and magnetic yoke 153 are laminated, and resilient binder element 17 having holes 17*m* and 17*n* embraces laminated magnetic pole piece 151 and magnetic yoke 153. Projections 151*m* and 151*n* are fitted into holes 17*m* and 17*n*, respectively. The resilient force of binder element 17 ensures tight coupling of magnetic pole piece 151 and magnetic yoke 153.

In the structure of FIG. 5, magnetic pole piece 151 and magnetic yoke 153 are laminated and are joined at points a, b, c, and d by means of, for example, hot or cold welding.

We claim:

1. An electromagnatic relay having an electromagnet comprising:

a bobbin having a central hole extending therethrough, said hole being formed with guide grooves of enlarged cross-section;

a coil wound on said bobbin;

an approximately U-shaped magnetic pole piece, one leg of which is longer than the other leg, the shorter leg being inserted under pressure into said guide grooves from one end of said bobbin;

an approximately U-shaped magnetic yoke, one leg of which is longer than the other leg, the shorter leg being inserted under pressure into the guide grooves from the other end of said bobbin in alignment with but not contacting said shorter end of said magnetic pole piece to form a magnetic gap;

said U-shaped magnetic pole piece and said U-shaped magnetic yoke being formed so that their longer legs extend around and overlap along the outer surface of said bobbin and are resiliently maintained in overlapping tight-fitting relationship; and an armature positioned in said central hole of said bobbin across said magnetic gap.

2. An electromagnetic relay having an electromagnet comprising:

a bobbin having a central hole extending therethrough, said hole being formed with guide grooves of enlarged cross-section;

a coil wound on said bobbin;

an approximately U-shaped magnetic pole piece, one leg of which is longer than the other leg, the shorter leg being inserted under pressure into said guide gro2ves from one end of said bobbin;

an approximately U-shaped magnetic yoke, one leg of which is longer than the other leg, the shorter leg being inserted under pressure into said guide grooves from the other end of said bobbin in alignment with but not contacting said shorter end of said magnetic pole piece to form a magnetic gap;

said U-shaped magnetic pole piece being formed with its upper corner angle slightly greater than 90°, and said U-shaped magnetic yoke being formed with its upper corner angle slightly less than 90°, and said magnetic yoke being inserted so that its longer leg extends over the longer leg of said pole piece in overlapping position and is resiliently maintained in tight-fitting contact therewith without being physically joined thereto; and an armature positioned in said central hole of said bobbin across said magnetic gap.

3. An electromagnetic relay having an electromagnet comprising:

a bobbin having a central hole extending therethrough, said hole being formed with guide grooves of enlarged cross-section;

a coil wound on said bobbin;

an approximately U-shaped pole piece, one leg of which is longer than the other leg, the shorter leg being inserted under pressure into said guide grooves from one end of said bobbin;

an approximately U-shaped magnetic yoke, one leg of which is longer than the other leg, the shorter leg being inserted under pressure into said guide grooves from the other end of said bobbin in alignment with but not contacting said shorter end of said magnetic pole piece to form a magnetic gap;

said magnetic pole piece being formed with projections along one edge of its longer leg, said longer leg of said pole piece and said longer leg of said yoke being formed to overlap outside said bobbin;

a resilient binder element having holes formed therein, said resilient binder element embracing said pole piece and said yoke with said projections fitted into said holes and arranged to maintain said pole piece and said yoke in tight-fitting overlapping contact; and an armature positioned in said central hole of said bobbin across said magnetic gap.

* * * * *

UNITED STATES PATENT AND TRADEMARK OFFICE

CERTIFICATE OF CORRECTION

PATENT NO. : 4,472,699

DATED : September 18, 1984

INVENTOR(S) : KUNIHISA FUJII et al

ASSIGNEE : TAKAMISAWA ELECTRIC CO., LTD

It is certified that error appears in the above-identified patent and that said Letters Patent is hereby corrected as shown below:

(1.) In Claim No. 2, Column 4, Line 12, Change "gro2ves" to --grooves--.

Signed and Sealed this

Seventh Day of May 1985

[SEAL]

*Attest:*

DONALD J. QUIGG

*Attesting Officer* *Acting Commissioner of Patents and Trademarks*